US008668020B2

(12) United States Patent
Guitierrez et al.

(10) Patent No.: US 8,668,020 B2
(45) Date of Patent: Mar. 11, 2014

(54) EMERGENCY BOWL FOR DEPLOYING CONTROL LINE FROM CASING HEAD

(75) Inventors: Genith del Carmen Guitierrez, Katy, TX (US); Todd Travis, Humble, TX (US); Brandon M. Cain, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 1 day.

(21) Appl. No.: 12/949,983

(22) Filed: Nov. 19, 2010

(65) Prior Publication Data

US 2012/0125634 A1 May 24, 2012

(51) Int. Cl.
*E21B 19/00* (2006.01)

(52) U.S. Cl.
USPC ..... 166/379; 166/88.4

(58) Field of Classification Search
USPC ..... 166/379, 385, 85.5, 88.4, 88.1, 242.7
See application file for complete search history.

(56) References Cited

U.S. PATENT DOCUMENTS

| | | | | | |
|---|---|---|---|---|---|
| 1,988,442 | A | * | 1/1935 | Begg | 166/89.3 |
| 2,001,946 | A | * | 5/1935 | Tschappat | 285/123.9 |
| 2,220,359 | A | * | 11/1940 | Tschappat | 166/88.3 |
| 2,284,869 | A | * | 6/1942 | Hinderliter | 277/324 |
| 2,887,754 | A | * | 5/1959 | Johnson | 188/67 |
| 2,956,626 | A | * | 10/1960 | Hall | 166/55 |
| 3,127,197 | A | * | 3/1964 | Kretzschmar | 285/123.2 |
| 3,130,987 | A | * | 4/1964 | Johnson | 285/123.8 |
| 3,299,951 | A | * | 1/1967 | Todd | 166/348 |
| 3,387,851 | A | * | 6/1968 | Cugini | 277/318 |
| 3,638,721 | A | * | 2/1972 | Harrison | 166/351 |
| 3,844,345 | A | * | 10/1974 | Evans et al. | 166/72 |
| 3,965,977 | A | * | 6/1976 | Beson | 166/88.4 |
| 4,268,283 | A | * | 5/1981 | Roberts | 96/174 |
| 4,307,783 | A | * | 12/1981 | Lanmon, II | 166/379 |
| 4,553,589 | A | * | 11/1985 | Jennings et al. | 166/53 |

(Continued)

FOREIGN PATENT DOCUMENTS

| | | | |
|---|---|---|---|
| GB | 2161188 | A | 1/1986 |
| GB | 2410514 | A | 8/2005 |
| WO | 2005/031205 | A2 | 4/2005 |

OTHER PUBLICATIONS

Combined Search and Examination Report in counterpart UK Appl. No. 1118954.5, dated Dec. 20, 2011.

(Continued)

*Primary Examiner* — Shane Bomar
*Assistant Examiner* — Wei Wang
(74) *Attorney, Agent, or Firm* — Wong, Cabello, Lutsch, Rutherford & Brucculeri LLP

(57) ABSTRACT

An assembly supports a control line of a downhole tool, such as a downhole deployment valve. The tool deploys on casing and has a control line extending from the wellhead to the tool. To support the line separately from any casing hanger, a split bowl disposes around the casing and lands on a shoulder in the head. A port in the bowl has one opening that aligns with a side port in the head. Another opening of the bowl's port connects to the control line that extends to the downhole tool. A section of the control line from the split bowl can be flexible to help prevent kinking or breaking of the line during installation procedures. A hanger disposes on another shoulder in the head uphole from the bowl. The hanger supports the casing in the head separate from the bowl's support of the control line.

23 Claims, 6 Drawing Sheets

(56) References Cited

U.S. PATENT DOCUMENTS

| | | | | |
|---|---|---|---|---|
| 4,605,063 | A * | 8/1986 | Ross | 166/216 |
| 4,623,020 | A * | 11/1986 | Nichols | 166/88.4 |
| 4,880,061 | A * | 11/1989 | Ahlstone | 166/348 |
| 4,886,121 | A * | 12/1989 | Demny et al. | 166/382 |
| 5,031,696 | A * | 7/1991 | Zwiegel | 166/208 |
| 5,524,710 | A * | 6/1996 | Shinn | 166/348 |
| 5,544,706 | A * | 8/1996 | Reed | 166/379 |
| 5,555,935 | A * | 9/1996 | Brammer et al. | 166/88.1 |
| 5,699,858 | A * | 12/1997 | McAnally | 166/382 |
| 5,725,056 | A * | 3/1998 | Thomson | 166/382 |
| 5,730,473 | A * | 3/1998 | Wilkins et al. | 285/26 |
| 5,893,417 | A * | 4/1999 | Pizzolato | 166/377 |
| 6,095,242 | A * | 8/2000 | Lequang et al. | 166/88.2 |
| 6,119,773 | A * | 9/2000 | Gariepy et al. | 166/88.1 |
| 6,244,348 | B1 | 6/2001 | Gariepy et al. | |
| 6,386,291 | B1 * | 5/2002 | Short et al. | 166/368 |
| 6,470,971 | B1 * | 10/2002 | Bridges | 166/379 |
| 6,491,102 | B2 * | 12/2002 | Leismer et al. | 166/316 |
| 6,588,510 | B2 * | 7/2003 | Card et al. | 166/382 |
| 6,644,401 | B1 * | 11/2003 | Miller | 166/75.14 |
| 6,675,900 | B2 * | 1/2004 | Baskett et al. | 166/379 |
| 6,871,708 | B2 * | 3/2005 | Calder et al. | 166/348 |
| 6,920,931 | B1 * | 7/2005 | Webre et al. | 166/379 |
| 6,942,028 | B2 * | 9/2005 | Hosie | 166/88.4 |
| 6,962,205 | B1 * | 11/2005 | Lay, Jr. | 166/368 |
| 6,966,383 | B2 * | 11/2005 | Milberger et al. | 166/368 |
| 7,117,945 | B2 * | 10/2006 | Hopper et al. | 166/348 |
| 7,128,143 | B2 * | 10/2006 | Van Bilderbeek | 166/96.1 |
| 7,134,490 | B2 * | 11/2006 | Nguyen | 166/208 |
| 7,159,663 | B2 * | 1/2007 | McGuire et al. | 166/379 |
| 7,231,983 | B2 * | 6/2007 | Lequang et al. | 166/379 |
| 7,314,086 | B2 * | 1/2008 | Hopper et al. | 166/348 |
| 7,350,590 | B2 | 4/2008 | Hosie et al. | |
| 7,413,018 | B2 * | 8/2008 | Hosie et al. | 166/379 |
| 7,419,001 | B2 * | 9/2008 | Broussard | 166/77.51 |
| 7,493,962 | B2 * | 2/2009 | Sheffield | 166/381 |
| 7,566,045 | B2 * | 7/2009 | June | 251/149.6 |
| 7,604,047 | B2 * | 10/2009 | Broussard | 166/75.14 |
| 7,610,956 | B2 * | 11/2009 | Farquharson et al. | 166/86.1 |
| 7,615,893 | B2 * | 11/2009 | Biester et al. | 307/82 |
| 7,699,099 | B2 * | 4/2010 | Bolding et al. | 166/89.1 |
| 7,730,956 | B2 * | 6/2010 | Smithson | 166/385 |
| 7,730,968 | B2 * | 6/2010 | Hosie et al. | 175/40 |
| 7,740,061 | B2 * | 6/2010 | Van Bilderbeek et al. | 166/96.1 |
| 7,779,921 | B2 * | 8/2010 | Cain et al. | 166/379 |
| 7,845,415 | B2 * | 12/2010 | Allen | 166/375 |
| 7,980,315 | B2 * | 7/2011 | Bolding et al. | 166/375 |
| 8,196,649 | B2 * | 6/2012 | Allen et al. | 166/72 |
| 2004/0079532 | A1 | 4/2004 | Allen et al. | |
| 2007/0034379 | A1 * | 2/2007 | Fenton et al. | 166/368 |
| 2008/0121400 | A1 | 5/2008 | Allen | |
| 2009/0032241 | A1 | 2/2009 | Allen et al. | |
| 2009/0223674 | A1 * | 9/2009 | Christie | 166/368 |

OTHER PUBLICATIONS

Examiner's First Report in counterpart Australian Appl. No. 2011244948, dated Feb. 20, 2013.

* cited by examiner

EMERGENCY BOWL FOR DEPLOYING CONTROL LINE FROM CASING HEAD

BACKGROUND

A wellbore 10 in FIG. 1A has casing 12/16 disposed in the wellbore 10 and held in pace by cement 15. The casing 12/16 extends from a wellhead 20, which has valve elements 22 to control the flow of fluid from the wellbore 10 as schematically shown. Downhole, the inner casing 12 has a downhole deployment valve (DDV) tool 30 that operates as a check valve separating uphole and downhole portions 14*u-d* of the casing 12 when closed.

Disposed on the casing 12, the DDV tool 30 can have a housing 32, a flapper 34 with a hinge 36 at one end, and a valve seat 35 in an inner diameter of the housing 32 adjacent the flapper 34. Alternatively, the flapper 34 may be replaced by a ball valve (not shown) or some other mechanism. A more detailed discussion of a DDV tool can be found in U.S. Pat. No. 7,350,590, which is incorporated herein by reference.

Typically, the DDV tool 30 threads to the casing 12 so the DDV tool 30 forms part of the casing string. This allows the DDV tool 30 to be run into the wellbore 10 along with the casing 12 prior to cementing operations. Alternatively, the DDV tool 30 can be run with a liner hanger and a tieback assembly or some other technique.

Once installed downhole, the DDV tool 30 acts as a one-way valve and can be remotely operated through an armored control line 44 that runs from the DDV tool 30 to the surface. Clamps (not shown) typically hold the control line 44 to the casing 12 at regular intervals for protection, and the control line 44 cements in the cemented area around the casing 12.

At the surface, a rig control system 40 communicates with the DDV tool 30 via the control line 44 and operates the DDV tool 30 by remotely opening and closing the flapper 34 from the surface of the well. Typically, the control system 40 uses the control line 44 to carry hydraulic fluid or electrical current to an actuator 38 on the DDV tool 30. Once actuated, the flapper 34 can open or close the bore through the tool 30.

When closed, the DDV tool 30 isolates the uphole portion 14*u* of the casing 12 from the downhole portion 14*d* so any pressure remaining in the uphole portion 14*u* can be bled out through the valve assembly 22 at the surface. With the uphole portion 16*u* of the wellbore free of pressure, the wellhead 20 can be opened so operators can perform various operations, such as inserting or removing a string of tools. Downhole, the DDV tool 30 allows a downhole assembly 25 on drillpipe to pass through the DDV tool 30 when opened. When the drilling assembly 25 trips out of the well, the DDV tool 30 can close and seal off the downhole fluids again.

To connect the control system 40 to the DDV tool 30, hydraulic fluid or power has to pass through the wellhead 20. As noted previously, the DDV tool 30 is run downhole disposed on the casing 12 with the control line 44 running along the casing 12. At the surface, a casing hanger (not shown) installs on the proximate end of the casing 12, and the control line 44 runs from the hanger down to the DDV tool 30. The DDV tool 30, control line 44, casing 12, and casing hanger lower into the wellhead 20 until the casing hanger lands on an internal shoulder of the wellhead 20. Once landed, ports in the wellhead 20 and casing hanger allow hydraulic fluid or power from the control system 40 to pass through the wellhead 20, to the control line 44, and down to the DDV tool 30.

As an example, FIG. 1B shows a casing hanger 50 for supporting a control line 44 of a DDV tool 30 in a wellhead as disclosed in US2008/0121400. The hanger 50 includes a passageway 51 through which hydraulic fluid can flow through the hanger 50 between the control system's hydraulic line 42 at the head 24 and the hydraulic control line 44 extending down to the DDV tool 30. The passageway 51 provides a conduit to a side of the hanger 50. The passageway 51 can extend in a different direction to create a second passageway 53 in the side of the hanger 50. A hydraulic tool port 52 formed on the passageway 51 couples to the hydraulic line 44.

At the wellhead 20, a hydraulic side port 54 is formed at the exit of passageway 53 in the side. An access opening 26 to the hydraulic side port 54 is formed to the side of the head 24 and aligned with the hydraulic side port 54 on the hanger 50 when the hanger 50 is seated in the head 24. The side port 54 can be disposed in a skirt of the hanger 50, where the skirt is generally a reduced concentric portion of the hanger 50. The skirt is situated below a shoulder 58 of the hanger 50 where the shoulder 58 is sized to engage a corresponding landing 28 on the head 24.

Although the arrangement of FIG. 1B may be effective, operators may need to install a casing hanger in an emergency operation to support the casing if problems occur during installation of casing having a DDV tool. For example, the casing may become stuck when being run downhole, and operators may need to install an emergency casing hanger on the DDV casing head of the wellhead.

Typically, operators use a slip hanger to support the casing in such an emergency operation. However, a typical slip hanger lacks features that allow control lines to pass in effective way. In the past, operators have used through holes in the slip hanger to pass the control lines. Unfortunately, handling the control lines and slip hanger in an emergency operation can be difficult, and the control line can rupture due to tension applied when moving the casing and installing the slip hanger.

The subject matter of the present disclosure is directed to overcoming, or at least reducing the effects of, one or more of the problems set forth above.

SUMMARY

A wellhead assembly supports a control line of a downhole tool, such as a downhole deployment valve. The downhole tool deploys on casing and has a control line extending from the tool to the wellhead. At the wellhead, a casing head has a bore with first and second shoulders and defines at least one side port therein. To support the control line separately from any casing hanger, a split bowl disposes around the casing and lands on a second (lower) shoulder in the casing head. The bowl has segments that affix together when disposed around the casing. A communication port in the bowl has one opening that aligns with the at least one side port in the casing head when landed therein. A second opening of the communication port connects to the control line that extends to the downhole tool. A section of the control line extending from the split bowl can be flexible to help prevent kinking or breaking of the control line during installation procedures. A hanger disposes on a first (upper) shoulder in the casing head uphole from the bowl. The hanger supports the casing in the head separate from the bowl's support of the control line. In one arrangement, the hanger is a slip hanger having slips.

The foregoing summary is not intended to summarize each potential embodiment or every aspect of the present disclosure.

DETAILED DESCRIPTION

Figure 1A:
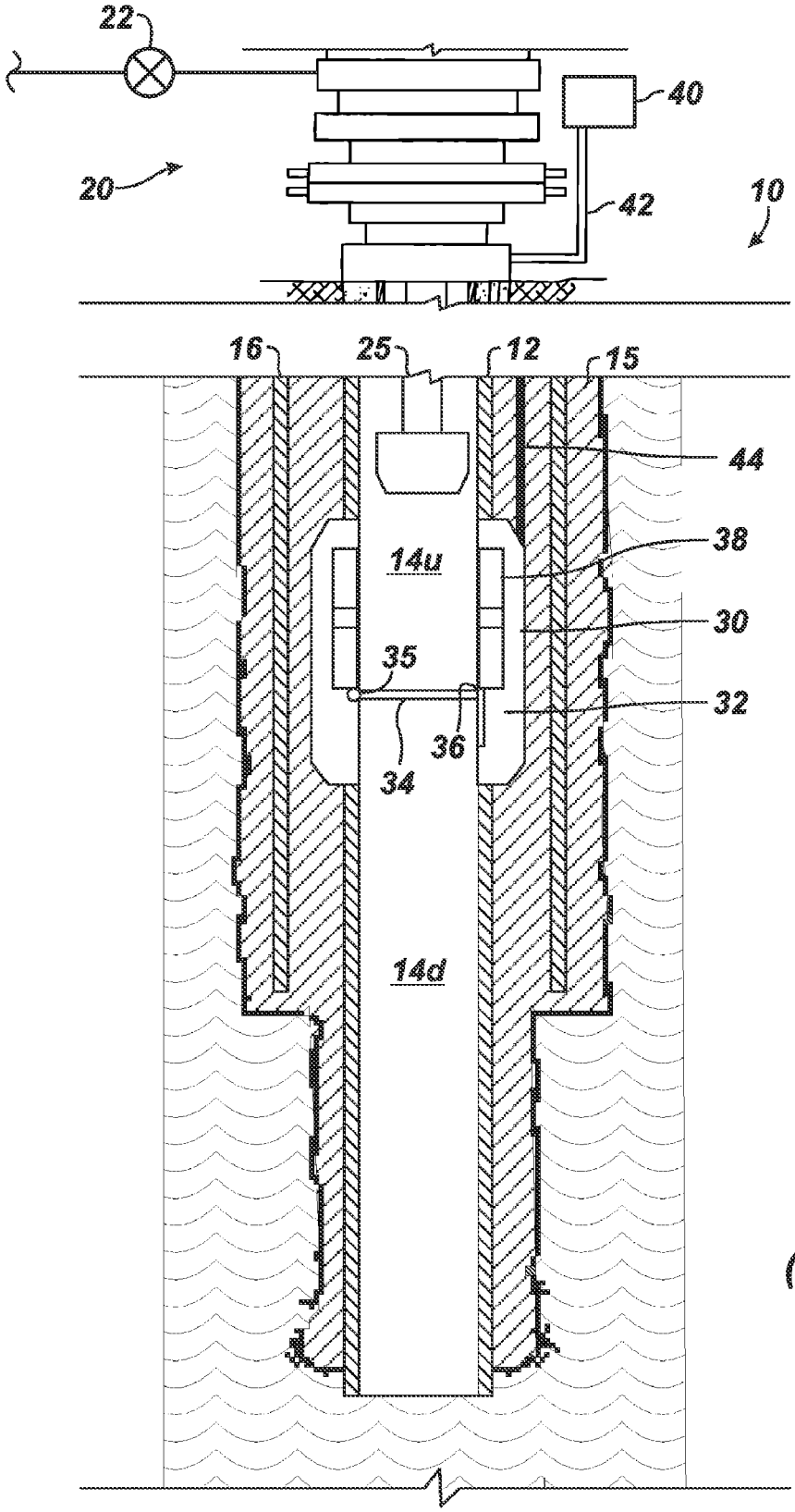
FIG. 1A (Prior Art)
FIG. 1A illustrates a wellbore having a downhole deployment valve (DDV) tool deployed on casing from a wellhead.
Figure 1B:
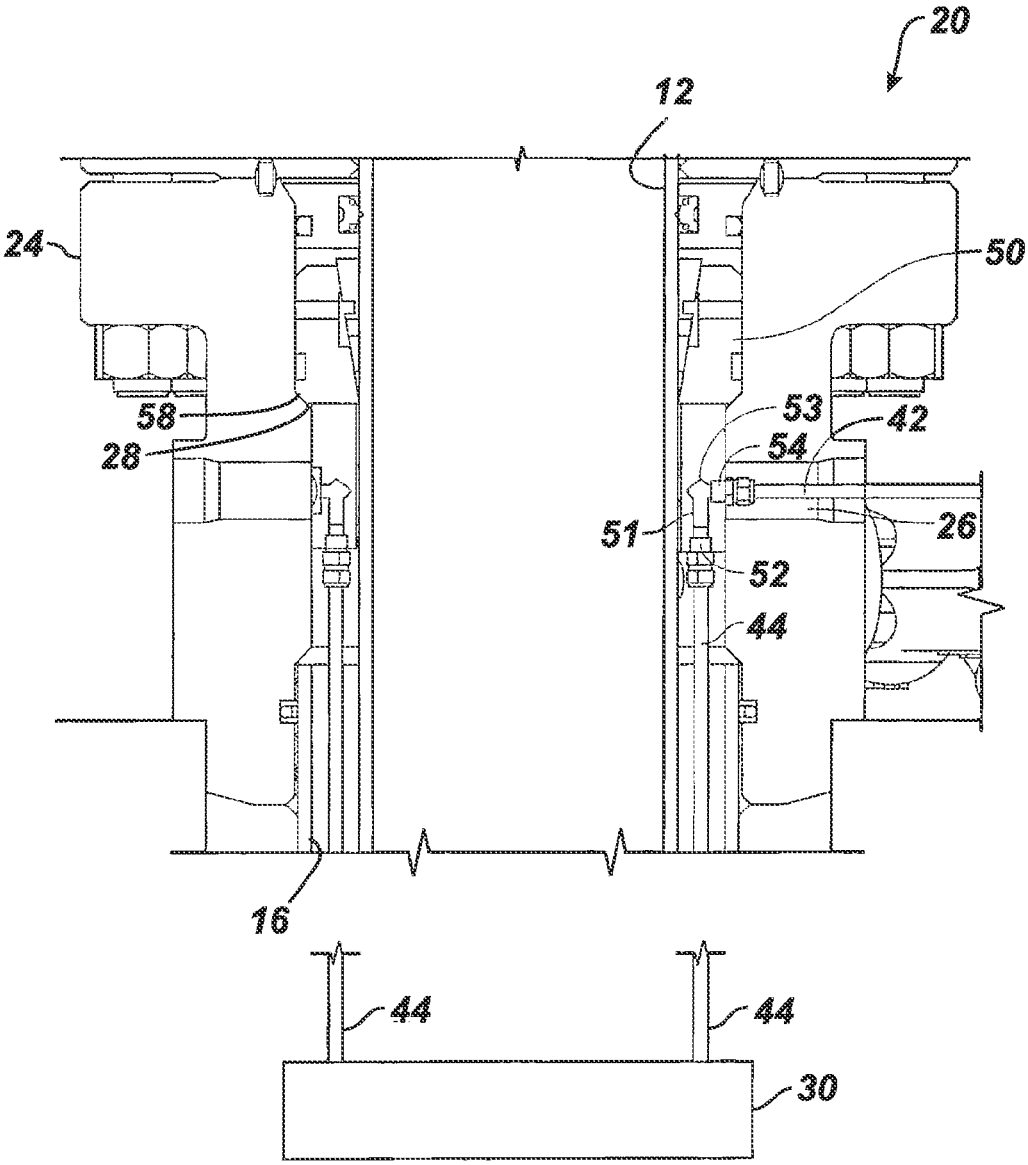
FIG. 1B (Prior Art)
FIG. 1B shows a casing hanger for supporting casing and a control line of a DDV tool in a wellhead according to the prior art.
Figure 2A:
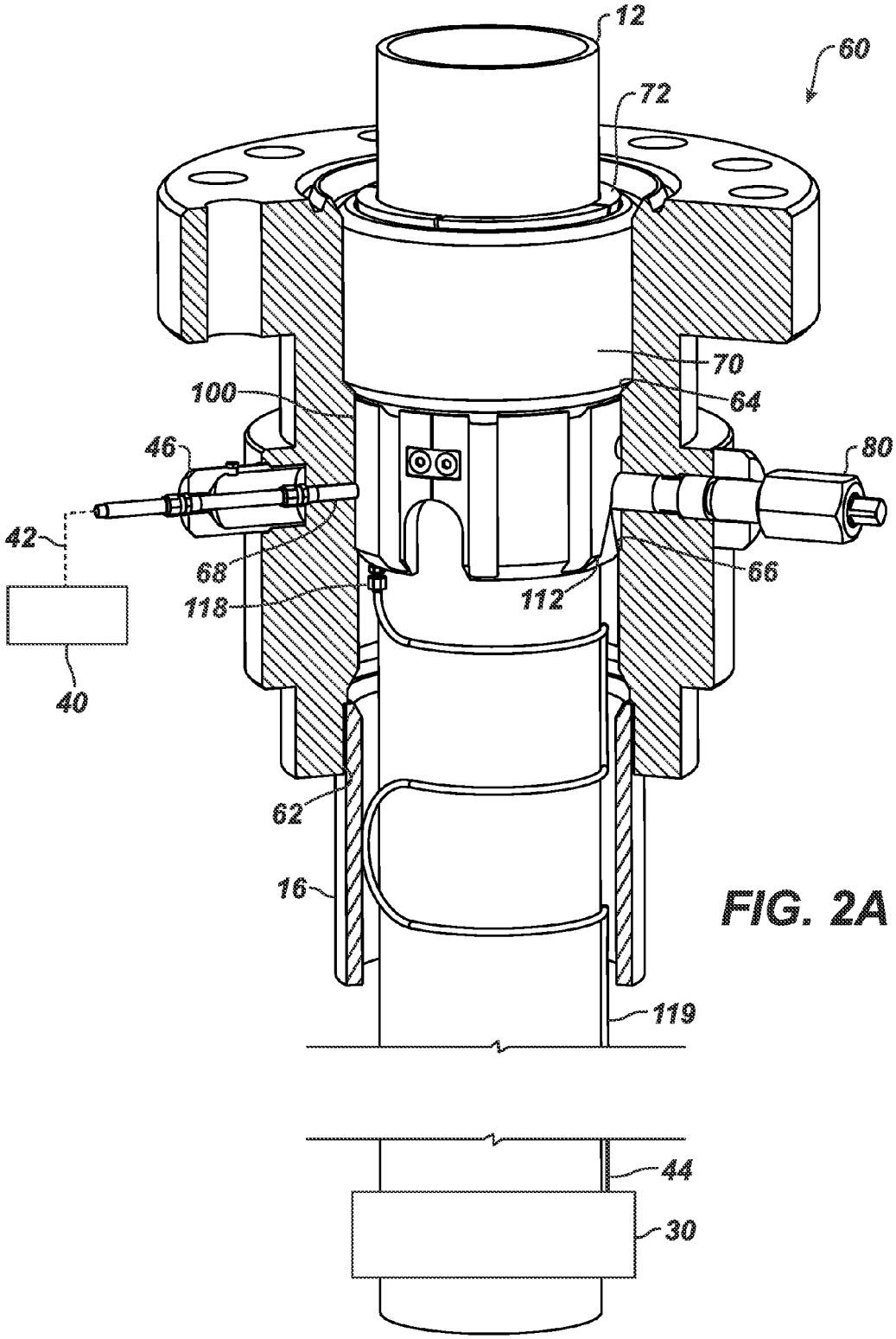
FIGS. 2A-2C illustrate a casing head for a wellhead having a slip hanger and a split bowl according to the present disclosure.
Figure 2B:
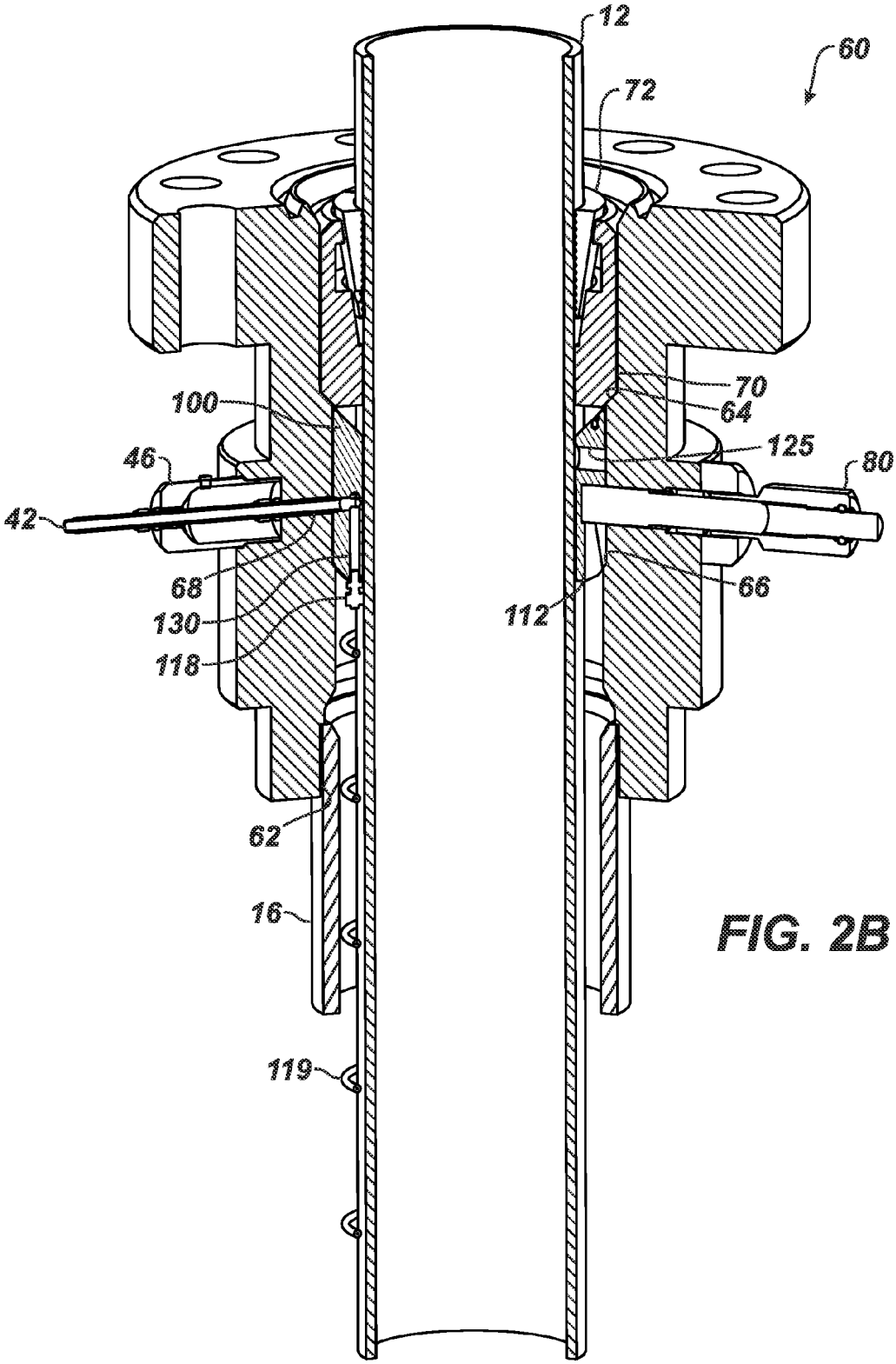
Figure 2C:
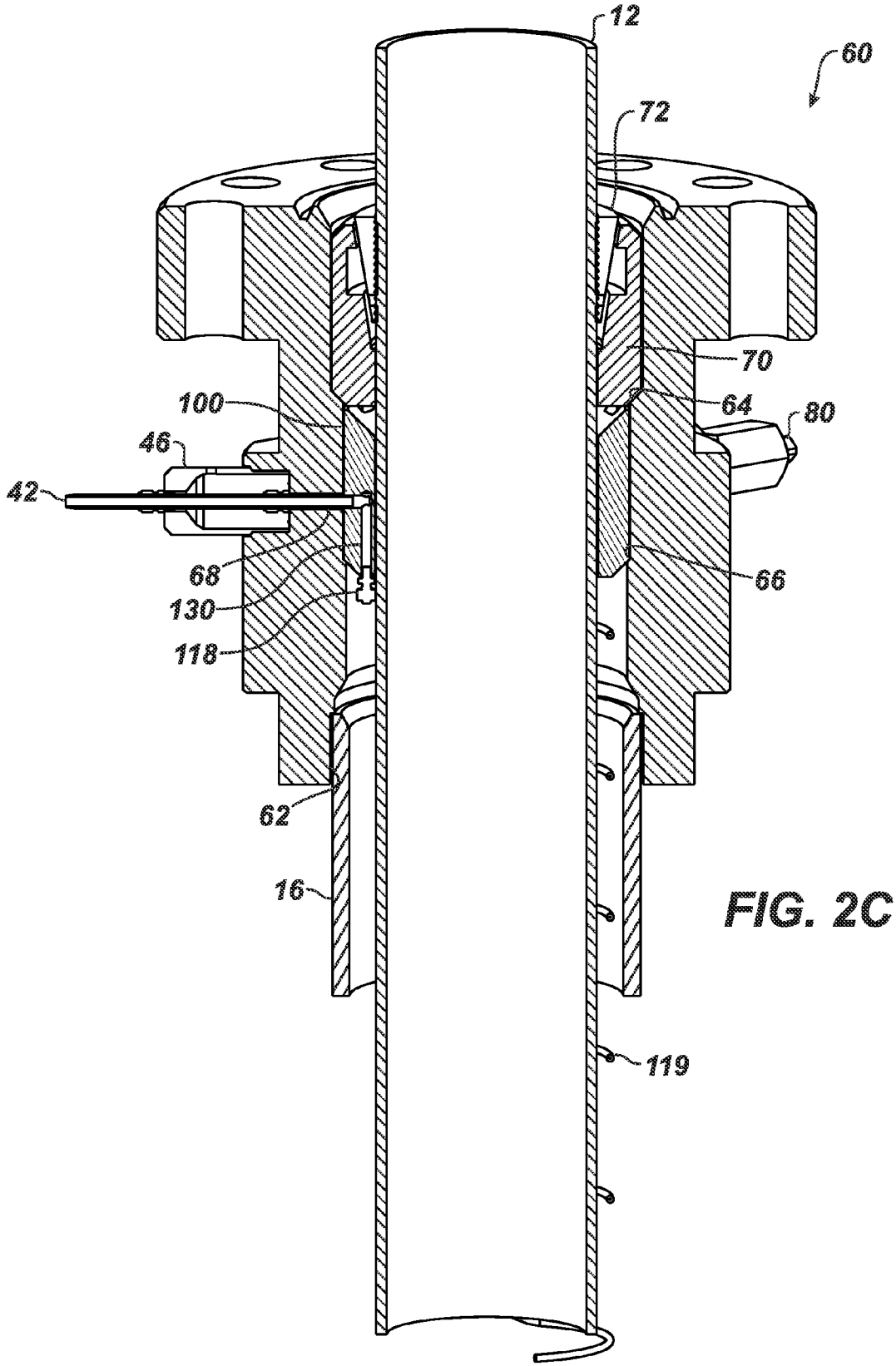

A wellhead shown in FIGS. 2A-2C has a casing head 60 that disposes on outer casing 16. Inner casing 12 disposes through the casing head 60 to be supported therein. Other portions of the wellhead, such as a blowout preventer and the like, are not shown for simplicity. On the casing 12, a downhole tool 30 deploys in the wellbore. In general, the downhole tool 30 can be a downhole deployment valve (DDV) or some other tool that needs a control line 44 for hydraulics, power, or the like.

When running the casing 12 through the casing head 60, a conventional casing hanger for use with the downhole tool 30 and control line 44 typically installs on a proximate end of the casing 12. When the desired depth is reached, the conventional hanger lands in the casing head 60 to support the casing 12 so the control line 44 can communicate with a rig control system 40.

Unfortunately, problems may occur when running the casing 12 downhole. For example, the casing 12 may become stuck before reaching its desired depth. When this occurs, the conventional casing hanger cannot be used, and operators need to install a different casing hanger to support the casing 12 in an emergency operation.

During such an emergency operation, operators break the stack, cut the casing 12 as needed, and then use a slip hanger 70 as shown to support the casing 12 in the casing head 60. The slip hanger 70 uses a number of slips 72 that wedge between the slip hanger 70 and the casing 12 to support the casing's weight. However, the slip hanger 70 typically lacks features that allow a control line for the downhole tool 30 to exit in an effective way. Moreover, when installing the slip hanger 70 during the emergency operation, the control line 44 for the downhole tool 30 can become damaged.

Figure 3:
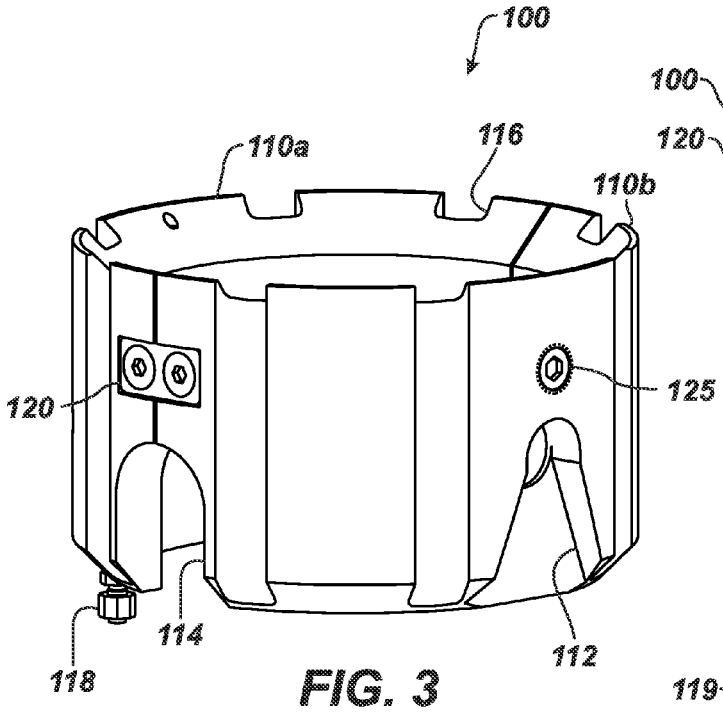
FIG. 3 shows an isolated view of the split bowl according to the present disclosure.

To deal with this situation, operators use a split bowl 100 of the present disclosure to support the control line 44. As shown in FIG. 3, the split bowl 100 has two or more segments 110*a-b* that affix together with attachment plates 120 and bolts, although other fasteners, such as tangential bolts or the like, can be used. On its outside surface, the split bowl 100 has an alignment pin slot 112 that fits on an alignment or locking pin (80; FIGS. 2A-2C) when landed in the casing head (60). In this way, the slot 112 properly aligns the bowl 100 in the casing head (60) so the bowl 100 can be locked in place. Flutes 116 defined around the split bowl 100 permit flow returns to pass between the casing head (60) and the bowl 100. Cutaways 114 on the bowl 100 accommodate any outlets (not shown) in the casing head (60).

Figure 4:
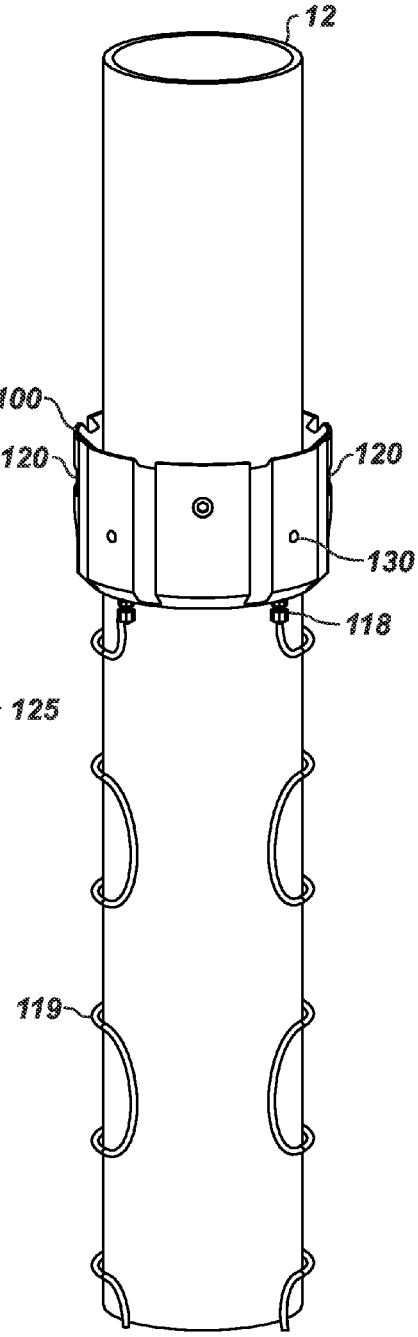
FIG. 4 shows the split bowl along with a control line disposed on casing.

As shown in FIG. 4, the segments 110*a-b* of the split bowl 100 fit around casing 12, and the attachment plates 120 or other fasteners affix the ends of these segments 110*a-b* together. Nuts or other fasteners thread into fastener holes 125 in the sides of the segments 110*a-b* to hold the bowl 100 in place on the casing 12.

As also shown, the bowl 100 has one or more ports 130 defined therein and offset from one another. The side openings of these ports 130 align with supply ports (68) on the casing head (60) when landed in the casing head (60), as shown in FIGS. 2A-2C. Lower openings of these ports 130 connect to control lines. For example, FIG. 4 shows sections 119 of the control lines 44 connected from the lower openings of the bowl's ports 130 using fittings 118. More than one control line 44 can extend from the bowl 100 from any of the various ports 130 provided. Unused ports 130 can be plugged using conventional techniques.

The control line section 119 can have a flexible length of control line extending from the split bowl 100 along portion of the casing 12. The overall length of this section 119 can depend on the implementation and the needs of a given installation. Overall, this flexible section 119 can prevent the control line 44 from breaking or kinking during the emergency casing hanger installation described herein. In general, the section 199 can be a separate length of control line appropriately coupled to a main section of the control line 44 already deployed downhole. Alternatively, the existing control line 44 can be wound to produce the flexible section 119 desired. These and other techniques available in the art can be used.

In any event, after affixing the bowl 100 on the casing 12 and connecting the control line 44 to the bowl 100, operators land the split bowl 100 on the second (lower) shoulder 66 defined in the head's bore 62 as shown in FIGS. 2A-2C. As noted above, the alignment pin slot (112; FIG. 3) fits on an alignment pin 80 in the casing head 60 so the bowl's ports 130 can be properly aligned. Furthermore, engagement of the slot 112 and pin prevents the bowl 100 from rotating. As also noted above, the flutes (116; FIG. 3) around the bowl 100 permit flow returns to pass between the casing head 60 and the bowl 100.

Above the split bowl 100, operators then install the slip hanger 70 around the casing 12 and land the hanger 70 on the first (upper) shoulder 64 of the casing head 60. As mentioned previously, this slip hanger 70 has slips 72 that grip and wedge into the casing 12 to support it in the head 60. To set the slip hanger 70, the casing 12 must typically be pulled in tension so that the slips 72 can wedge between the hanger 70 and the casing 12 when the casing's weight is released. Having the flexible section 35 on the control line 44 helps to prevent the control line 44 from breaking or kinking when tension is applied and released on the casing 12 when setting the slip hanger 70 in this way.

Being separate from the casing hanger 70, the split bowl 100 helps protect the control line 44 and helps ensure that the control line 44 will communicate with the supply ports 68 in the casing head 60. Once the emergency operation is complete and the slip hanger 70 is set, operators can perform any of the other necessary operations. For example, operators connect a supply line 42 from the rig control system 40 to the supply port 68 on the casing head 60 using a hydraulic connector 46. From there, hydraulics, power, or the like can be conveyed through the split bowl's port 130 to the control line 44 extending therefrom and downhole to the tool 30.

The foregoing description of preferred and other embodiments is not intended to limit or restrict the scope or applicability of the inventive concepts conceived of by the Applicants. Although disclosed in conjunction with a downhole deployment valve, the teachings of the present disclosure can apply to any downhole tool disposed on casing that has a control line for power, hydraulics or the like. In addition, although only one control line has been shown connecting to a downhole tool, it will be appreciated that the split bowl, casing head, and control system can have any number of control lines for communicating with one or more tools downhole.

Moreover, the present disclosure has described using the split bowl during an emergency operation when a conventional casing hanger cannot be used and a slip hanger may instead be used. It will be appreciated with the benefit of the present disclosure that the split bowl and its features can be beneficial when any type of casing hanger is to be used to support casing in a casing head where there is a control line present. Thus, the teachings of the present disclosure are not limited to an emergency operation when a slip hanger needs to be used in a casing head because another type of hanger cannot be used. Instead, the split bowl of the present disclosure can be used with any type of hanger for supporting casing in a head regardless of whether operators need to install the components in an emergency or planned operation.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An emergency assembly for supporting a casing in a wellhead and for supporting a control line of a downhole tool deployed on the casing from the wellhead, the wellhead having a bore with first and second shoulders and defining at least one side port, the assembly comprising:

a control line hanger disposing on the second shoulder in the bore of the wellhead and having a plurality of segments, the segments being independent of the casing and affixing laterally together around the casing, the control line hanger defining at least one communication port, the at least one communication port communicating with the side port in the wellhead and communicating with the control line of the downhole tool; and a casing hanger being independent of the control line hanger, the casing hanger disposing on the first shoulder in the bore of the wellhead uphole of the control line hanger and supporting the casing therefrom, wherein the casing hanger supports the casing in tension while the control line hanger, being independent of the casing hanger and the casing, exclusively supports the control line.

2. The assembly of claim 1, wherein the casing hanger comprises a slip hanger having one or more slips engaging the casing.

3. The assembly of claim 1, wherein the control line hanger comprises at least two of the segments affixing together with fasteners.

4. The assembly of claim 1, wherein the control line hanger defines more than one of the at least one communication ports.

5. The assembly of claim 1, wherein the control line hanger defines a plurality of flutes allowing fluid communication in the bore of the wellhead past the control line hanger.

6. The assembly of claim 1, wherein the control line hanger defines a slot engaging an alignment pin disposed in the bore of the wellhead.

7. The assembly of claim 1, further comprising a bent section of the control line connected to the communication port of the control line hanger and being bent relative to the casing.

8. A wellhead assembly for supporting a control line of a downhole tool, the downhole tool deployed on casing, the assembly comprising:

a casing head having a bore with first and second shoulders and defining at least one side port therein;

a control line hanger disposing on the second shoulder in the bore of the casing head, the control line hanger having a plurality of segments, the segments being independent of the casing and affixing laterally together around the casing, the control line hanger defining at least one communication port, the at least one communication port communicating with the at least one side port in the casing head and communicating with the control line of the downhole tool; and a casing hanger disposing on the first shoulder in the bore of the casing head uphole from the control line hanger, the casing hanger being independent of the segments of the control line hanger and supporting the casing in the casing head, wherein the casing hanger supports the casing in tension while the control line hanger, being independent of the casing hanger and the casing, exclusively supports the control line.

9. The assembly of claim 8, wherein the casing hanger comprises a slip hanger having one or more slips engaging the casing.

10. The assembly of claim 8, wherein the control line hanger comprises at least two of the segments affixing together with fasteners.

11. The assembly of claim 8, wherein the control line hanger defines more than one of the at least one communication ports.

12. The assembly of claim 8, wherein the control line hanger defines a plurality of flutes allowing fluid communication in the bore of the casing head past the control line hanger.

13. The assembly of claim 8, wherein the casing head has an alignment pin disposed in the bore, and wherein the control line hanger defines a slot engaging the alignment pin, the engagement of the slot and the alignment pin preventing rotation of the control line hanger in the bore of the casing head.

14. The assembly of claim 8, further comprising a bent section of the control line connected to the communication port of the control line hanger and bent relative to the casing.

15. A method of supporting a casing in a wellhead and of supporting a control line of a downhole tool deployed on the casing, the method comprising:

disposing at least two segments of a control line hanger on the casing extending from a casing head of the wellhead by affixing the at least two segments laterally together around the casing, the at least two segments being independent of the casing;

connecting at least one control line to at least one communication port on the control line hanger;

disposing the control line hanger on a second shoulder in the casing head with the at least one communication port on the control line hanger communicating with at least one side port on the casing head; and supporting the casing in the casing head independent of the at least two segments of the control line hanger by disposing a casing hanger on the casing against a first shoulder in the casing head uphole from the second shoulder; and pulling tension on the casing for support in the casing hanger while leaving the control line hanger to exclusively support the control line.

16. The method of claim 15, wherein pulling tension on the casing for support in the casing hanger comprises:

setting slips on the casing hanger against the casing when pulling tension on the casing.

17. The method of claim 15, wherein connecting at least one control line to at least one communication port on the control line hanger comprises connecting a bent section of the at least one control line to the at least one communication port, the bent section being bent relative to the casing.

18. The method of claim 15, wherein pulling tension on the casing for support in the casing hanger comprises:

permitting bending or unbending of the bent section of the at least one control line connected to the control line hanger when pulling tension on the casing.

19. The method of claim 15, wherein affixing the at least two segments around the casing comprises affixing ends of the at least two segments together end-to-end.

20. The method of claim 15, further comprising allowing fluid communication between the control line hanger and the bore of the casing head.

21. The method of claim 15, further comprising allowing fluid communication between the control line hanger and the casing.

22. The method of claim 15, further comprising preventing rotation of the control line hanger in the bore of the casing head.

23. The method of claim 15, wherein the method is performed as an emergency installation and initially comprises:

disassembling a portion of the wellhead; and cutting the casing.

* * * * *